United States Patent [19]

Bourgeois

[11] Patent Number: 4,764,989

[45] Date of Patent: Aug. 23, 1988

[54] SAFETY GOGGLES RETAINER FOR HARD HAT

[75] Inventor: Roy M. Bourgeois, Baton Rouge, La.

[73] Assignee: American Allsafe Company, Irving, Tex.

[21] Appl. No.: 52,616

[22] Filed: May 20, 1987

[51] Int. Cl.[4] ..... A42B 1/24; A61F 9/02

[52] U.S. Cl. ..... 2/422; 2/10; 2/452; 24/301

[58] Field of Search ..... 2/5, 6, 7, 8, 10, 422, 2/425, 426, 452; 24/300, 301

[56] References Cited

U.S. PATENT DOCUMENTS

| | | | |
|---|---|---|---|
| 1,832,747 | 11/1931 | Spoljarich | 2/10 |
| 3,273,163 | 9/1966 | Andrews | 2/422 |
| 3,373,444 | 3/1968 | Militello | 2/10 |
| 3,703,750 | 11/1972 | Irwin | 2/10 X |
| 3,781,915 | 1/1974 | Menold et al. | 2/10 |
| 3,808,604 | 7/1974 | Rose | 2/10 |
| 4,193,133 | 3/1980 | Laibach et al. | 2/10 |
| 4,276,657 | 7/1981 | Montesi | 2/422 |
| 4,555,815 | 12/1985 | Walther | 2/6 X |
| 4,686,712 | 8/1987 | Spiva | 2/10 |

FOREIGN PATENT DOCUMENTS

| | | | |
|---|---|---|---|
| 682644 | 2/1930 | France | 2/6 |
| 847458 | 7/1939 | France | 2/6 |

*Primary Examiner*—Wm. Carter Reynolds
*Attorney, Agent, or Firm*—Dennis T. Griggs

[57] ABSTRACT

A pair of strap retainers are mounted on opposite sides of a safety helmet for securing safety goggles in a storage position. An open slot is formed in each retainer thereby defining a hook about which the goggles strap is retained. The goggles along with the head strap are placed against the crown of the hard hat, and the loops defined on each side of the folded head strap is inserted into the retainer slots. The goggles are securely retained onto the helmet with the head strap following a curved path about the crown between the two retainers. Because the elastic goggles strap is retained within open slots, the goggles strap can be folded and quickly inserted into the slot for storage of the goggles, and can be quickly drawn out of the slot so that goggles can be worn independently of the helmet. Because the goggles are not directly attached to the helmet when worn, eye protection is provided during a blow-back incident since the goggles will remain in place about the wearer's head and will not be pulled away should the safety helmet be forceably removed by the blow-back.

7 Claims, 2 Drawing Sheets

SAFETY GOGGLES RETAINER FOR HARD HAT

FIELD OF THE INVENTION

This invention relates to personnel safety equipment, and in particular to hard hat and eye safety equipment intended for industrial use.

BACKGROUND OF THE INVENTION

Safety helmets, commonly referred to as "hard hats", provide limited protection against head and eye injury which might be caused by hazardous working conditions. Safety helmets include a hard shell and a suspension harness mounted within the shell which work together to reduce the impact of falling objects which strike the top of the shell. Safety goggles are sometimes worn with the hard hat and include an elastic strap which holds the goggles securely about the wearer's head. The purpose of the goggles is to prevent eye injury due to flying objects, and also protect the eyes from the exposure to smoke, noxious fumes and corrosive fluids.

The wearing of safety goggles is required by certain industrial safety regulations. Occasionally, a worker will be exposed to the blow-back of hazardous materials, with the force of the blow-back tending to remove the hard hat. Some eye injuries have been sustained as a result of the goggles being torn away along with the hard hat during a blow-back incident. Such eye injuries are more likely to occur if the strap of the safety goggles is attached directly to the hard hat. That is, the force of the blow-back may be so strong that the helmet will be blasted aside, pulling the goggles along with it, thus exposing the eyes of the wearer to the hazardous blow-back materials.

It will be appreciated that the risk of eye injury is substantially less if the safety goggles are secured about the head and neck of the wearer, that is, worn independently and not attached to the hard hat.

DESCRIPTION OF THE PRIOR ART

Because the wearing of hard hats and safety goggles is mandated under certain working conditions, it has been common practice to attach the head strap of the safety goggles directly to the hard hat. In some instances, the attachment of the goggles directly to the hard hat has been done for convenience so that the goggles would not have to be handled separately. Additionally, the goggles have been attached directly to the safety helmet so that they can be quickly pulled away from the crown and over the visor of the safety helmet and placed in the operative, shielding position across the wearer's eyes, while the safety helmet is being worn. In such arrangements, the goggles are provided with two straps, with one strap being attached on each side of the goggles, and with the free end of each strap being releasably fastened directly to the shell or headband suspension of the hart hat. In most instance, the goggle strap fastener attachments have been effected by releasable means, such as buckles, snaps and spring clips.

Although such prior art arrangements have provided accessibility and convenience for the wearer, a comfortable fit of the goggles against the wearer's face has been difficult to obtain because the straps were not permitted to follow the natural path of engagement about the wearer's head and neck which would ordinarily result by wearing the goggles separately with respect to the safety helmet. That is, with the ends of the goggles straps attached directly to the head gear, the goggles straps do not follow the natural horizontal or downwardly-sloping path which would normally be followed by the straps when worn separately from the helmet, but are instead pulled upwardly along an inclined path on opposite sides of the helmet. Because of this upwardly-slanting orientation of the straps, a lifting force is directed onto the goggles which tend to rotate the goggles slightly away from snug engagement against the wearer's face. This tends to interrupt the seal of the edge of the goggles about the wearer's face with the result that the wearer's eyes then become exposed for contact by blow-back material, noxious fumes and the like.

Moreover, in such prior art arrangements in which the goggles are attached directly to the hard hat, it is necessary to adjust the lengths of the separate straps so that the goggles will fit evenly and symmetrically about the wearer's eyes. Equal strap length on both sides of the goggles are provided in such arrangements by separate length adjustment clips on the free ends of the straps. Such adjustments are somewhat difficult to set up so that equal length and tension are provided in both straps.

In some hard hat configurations, the visor projects substantially forward of the crown so that in direct strap fastener arrangements, it is necessary to severely stretch the straps to permit the goggles to be pulled around the forwardly-projecting rim of the visor. Such a procedure can cause the strap and/or fastener to break or otherwise separate violently from the hard hat with the attendant risk of potential injury caused by the rapidly-retracting free end of the strap. In some instances, the straps are resilient but are too tight to permit the goggles to be pulled forwardly enough to clear the projecting rim of the visor. In such situations it is necessary to first release one of the strap fasteners to permit the goggles to be relocated and then reattach the strap to the safety helmet.

Accordingly, in view of the foregoing limitations of the directly-fastened goggles/hard hat arrangements, and because of the necessity that the goggles and hard hat be worn separately to avoid forceable removal of the goggles during a blow-back incident, there is a continuing interest in improving attachments for releasably storing goggles on a hard hat in such a manner that the goggles will be securely retained with the hard hat when the goggles are not being worn, but which are conveniently accessible and readily available for wear separate and apart from the hard hat.

OBJECTS OF THE INVENTION

It is, therefore, an object of this invention to provide an improved retainer for securing safety goggles onto a safety helmet.

Another object of the invention is to provide a retainer of the character described wherein safety goggles may be securely retained against the crown of a safety helmet without direct attachment of the goggle straps to the safety helmet.

A further object of the invention is to provide an improved construction for releasably storing goggles on a safety helmet whereby the goggles can be securely stored when not in use, but which can be quickly released for use independently of the helmet.

Yet another object of this invention is to provide an improved safety goggles retainer of the character set forth wherein the goggles can be conveniently mounted or removed from the crown of safety helmet without altering the length of the goggles head strap.

A related object of the invention is to provide retaining means of the character described in which safety goggles can be securely fastened to and easily removed from the crown of a safety helmet substantially without over-stretching the elastic goggles strap. The foregoing object is especially important for those occasions when the goggles are to be stored on the safety helmet over an extended period of time and over-stretching of the elastic strap during such an extended storage period would cause the goggles strap to weaken and lose its elasticity.

SUMMARY OF THE INVENTION

The foregoing objects are provided by the present invention in which a pair of strap retainers are mounted on opposite sides of a safety helmet. According to the preferred embodiment, pockets are formed in the shell on opposite sides of the helmet, and the retainers are received in the pockets in interlocking engagement with latching surfaces. Each strap retainer is provided with resilient arms which deflect upon insertion into and withdrawal from the pocket. Latching members are carried on the ends of the resilient arms which snap into detected engagement with latching surfaces formed on the pocket sidewall, and hold the retainer in its operative position.

An open slot is formed in each retainer thereby defining a hook about which the goggles strap is retained. According to this arrangement, the goggles along with the head strap are placed against the crown of the hard hat, and the loop defined by the folded head strap is inserted into the retainer slot and looped around the hooks on opposite sides of the hard hat. The goggles are securely retained onto the hard hat with the headstrap following a curved path about the crown of the hard hat between the two retainers. The elastic head strap undergoes a slight amount of the tensioning when folded and looped about the retainers with the result that the goggles are held securely against the crow of the hard hat.

According to the foregoing arrangement, the safety goggles are retained securely against the crown of the safety helmet in the storage position without direct attachment of the goggles strap to the shell of the safety helmet. Because the elastic strap is retained within an open slot formed in each retainer, the goggles strap can be folded and quickly inserted into the slot for storage, and can be quickly released for use of the goggles independently of the helmet. Accordingly, there is no need to alter or otherwise adjust the length of the goggles strap after its initial length has been fitted for a particular user. Moreover, a secure mounting of the goggles onto the hard hat is effected without over-stretching the elastic strap, so that the goggles can be retained on the hard hat over an extended period without weaking or otherwise damaging the elastic head strap.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1:
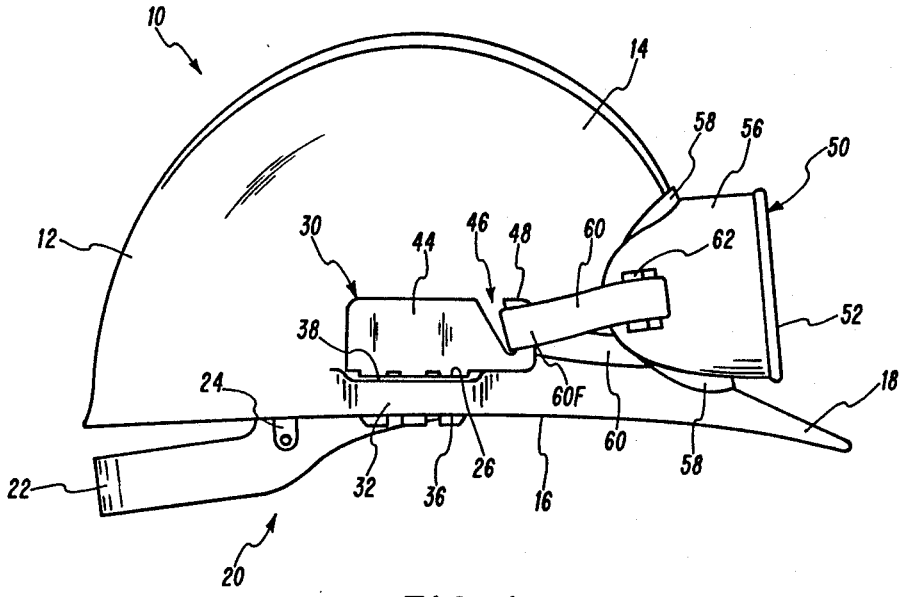
FIG. 1 is a side elevation view of a hard hat on which a retainer according to the present invention and safety goggles are mounted.

In the description which follows, like parts are marked throughout the specification and drawings with the same reference numerals, respectively. The drawings are not necessarily to scale and the proportions of certain parts have been exaggerated to better illustrate the details of the present invention.

Referring now to FIG. 1, a safety helmet 10 comprises a one-piece molded shell 12 of durable, high-impact material having a dome-shaped crown 14 which transitions into a radially-flared rim 16. A portion of the rim 16 is extended forwardly to define a protective visor 18. The visor 18 projects outwardly from the crown 14 a substantially greater distance than the side and back portions of the rim 16.

A harness assembly 20 is attached to the inner sidewall of the shell 12 and suspends a head band 22 away from the shell whereby a protective spacing is formed between the shell and the wearer's head. The head band 22 is adjustable in diameter and its position is maintained by stand-off support arms 24 which are attached to the inner sidewall of the shell 12. Crossed straps of durable webbing material are secured within the shell 12 and define a supporting crown which rests upon the wearer's head. The hard shell and suspension harness assembly work together to reduce the impact effect of falling objects which strike the top of the shell.

According to the preferred embodiment, pockets 26, 28 are formed in the shell 12 on opposite sides of the helmet for receiving a strap retainer 30. The pockets 26, 28 are bounded on one side by the shell 12 and on the other side by bracket panels 32, 34, respectively. Each bracket panel is provided with a lower edge 36 and an upper edge 38 which define latching surfaces for interlocking engagement with the retainer 30.

Figure 3:
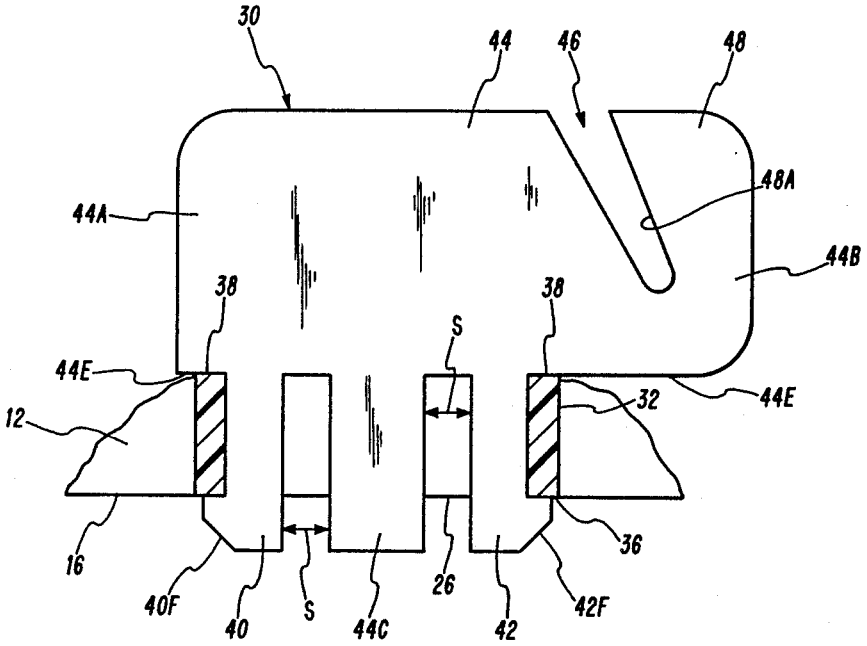
FIG. 3 is a sectional view, partly broken away, which illustrates the mounting of the retainer onto the hard hat of FIG. 1.
Figure 4:
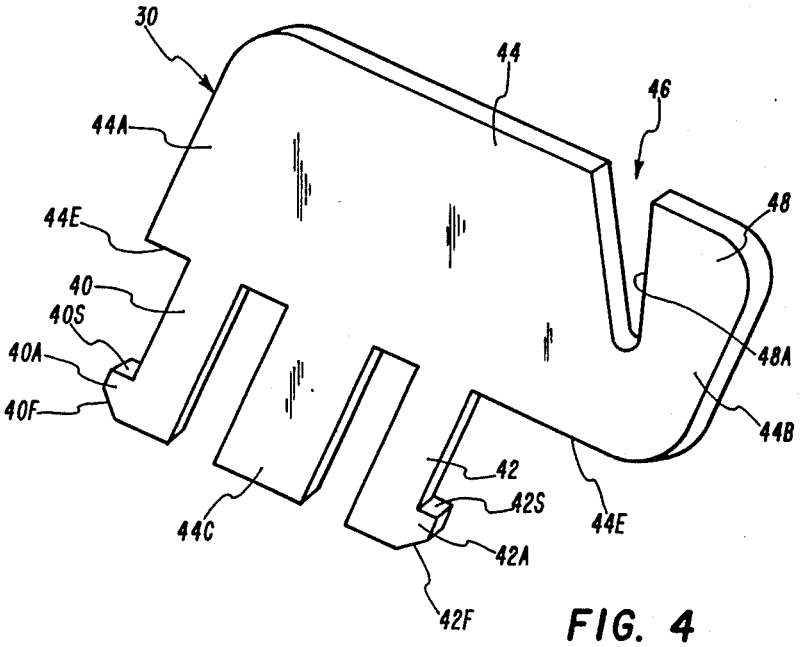
FIG. 4 is a perspective view of the retainer shown in FIG. 3.

Referring now to FIGS. 3 and 4, the strap retainer 30 is provided with resilient arms 40, 42 which project in spaced relation from an elongated body member 44. The body member 44 has first and second major end portions 44A, 44B. An open slot 46 is formed in the body member 44 at an intermediate location near the end portion 44B. The intersection of the open slot 46 in body member 44 defines a hook 48 having an edge 48A for engaging a goggles head strap. According to this arrangement, goggles can be mounted onto the crown 14 without direct attachment of the heat strap to the crown.

The resilient arm 40, 42 deflect inwardly toward a centrally-located stub 44C as they are inserted into the socket 26. The central stub 44C is laterally spaced with respect to the resilient arms 40, 42, thereby permitting the resilient arms to deflect inwardly as the arms are inserted into the socket 26. The spacing distance is indicated by the reference letter S. The spacing distance S permits the resilient arms to deflect inwardly toward the stub 44C so that the arms can be inserted into the slot 26, with the resilient arms engaging the stub 44C at the limit of their deflection to prevent the arms from being broken due to over-deflection.

The resilient arms 40, 42 are terminated by latching members 40A, 42A, respectively. The latching members are provided with shoulder surfaces 40S, 42S for engaging the lower edges 36 of the bracket panels 32, 34. Additionally, each latching member is provided with a sloping face 40F, 42F, respectively, which initially engage the upper edge 38 of the bracket panels, thereby causing the resilient arms 40, 42 to deflect inwardly as the arms are inserted into the retainer pockets 26, 28. The latching portions 40A, 42A snap into detented engagement with the lower edge 36 of the bracket members when the retainers are fully inserted. According to this arrangement, the bracket is engaged along its lower edge 36 and top edge 38 by the latch surfaces 40S, 42S and by the lower edge 44E of the body member.

Referring again to FIGS. 1 and 2, protective safety goggles 50 are mounted against the crown 14 of safety helmet 10. The safety goggles 50 include a frame 52 in which a safety lens 54 is mounted. A side shield/shroud 56 is attached to the rear of the frame 52. The safety goggles 50 are conventional in construction, with the side shield/shroud 56 and frame 52 configured appropriately to provide a conforming facial fit. For this purpose, the side shield 56 includes a soft, flexible flange 58 for engaging and sealing the facial areas about the eyes and nose of the wearer.

The safety goggles 50 are provided with an elastic head strap 60 in the form of a continuous strap which extends from one side of the side shield 56 to the other side. The ends of the head strap 60 are secured onto the side shield by bracket fasteners 62, 64. The ends of the elastic head strap 60 are looped through the bracket fasteners, with the length of the elastic head strap 60 being adjusted as desired for a particular user.

After the appropriate head strap length has been established, the safety goggles 50 are mounted onto the safety helmet 10 with the soft flange 58 of the side shield 56 being placed into conforming engagement with the crown 14. As can best be seen in FIG. 1, the elastic head strap 60 is folded near each end of the side shield 56 to produce folds 60F. The folds 60F are looped about the hooks 48, with the folded portion 60F of the elastic head strap 60 engaging the hook edge 48A within the open retainer slot 46.

Figure 2:
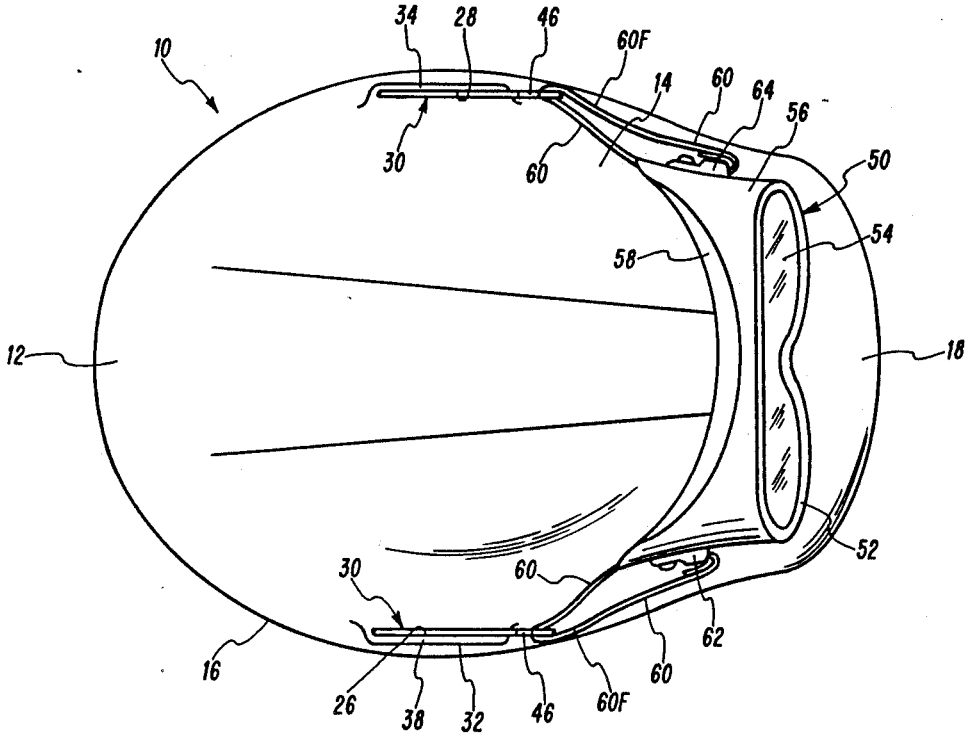
FIG. 2 is a top plan view of the hard hat and goggles combination as shown in FIG. 1.

In the foregoing arrangement, a substantial portion of the head strap 60 follows a curved path about the crown 14 between the two retainers 30. In the storage position as illustrated in FIGS. 1 and 2, the safety goggles 50 are securely retained onto the safety helmet 10 without direct attachment of the goggles strap 60 to the shell of the safety helmet. The elastic head strap 60 undergoes a slight amount of tensioning in the storage position so that the safety goggles 50 are held securely in place and will not fall off of the helmet under ordinary wearing conditions. However, because the elastic head strap is merely looped about the hook 48 within the open slot 46, the head strap 60 can be quickly released so that the goggles 50 can be used independently of the helmet 10, that is, with the head strap 60 fitted about the head of the wearer, and not attached directly to the safety helmet 10.

Accordingly, there is no need to alter or otherwise adjust the length of the goggles head strap 60 after its initial length has been fitted for a particular user. A secure mounting of the goggles 50 onto the hard hat 10 is effected without over-stretching the elastic strap 60, so that the safety goggles 50 can be retained on the hard hat over an extended period without weakening or otherwise damaging the elastic head strap 60. Moreover, the safety goggles 50 cannot be worn over the eyes while the head strap 60 is looped about the retaining hook 48, in part because of the forward location of retaining hook, and in part because most of the goggles strap 60 is curved about the crown of the helmet and therefore would not be available to permit the goggles to be pulled forward over the visor 18 to reach the wearer's face.

It will be seen, therefore, that a wide variety of conventional safety googles can be releasably secured to a safety helmet without modification of the safety goggles. Because a folded portion of the goggles head strap is looped about an open hook retainer, the goggles can be quickly removed merely by lifting the head strap vertically away from the open hook. The safety goggles can then be fitted over the eyes of the wearer and the safety helmet can be replaced onto the wearer's head.

As previously discussed, the goggles cannot be worn about the eyes while the head strap is engaged about the retainer hook. The goggles must be removed and fitted about the wearer's head separately with respect to the safety helmet. Because the goggles are not directly attached to the helmet, eye protection is provided during a blow-back incident since the goggles will remain in place about the wearer's head and will not be pulled away should the helmet be forceably removed by the blow-back.

Although the strap retainers 30 are shown mounted with the retainer hook portion in the forward position in the preferred embodiment, the orientation of the strap retainers can be reversed, with the retainer hook portion extending in the reverse direction so that the goggles can be mounted on the rear portion of the crown. In certain situations where extra safety equipment is required to be worn or attached to the safety helmet, it is desirable that the retainers 30 be reversed thus positioning the goggles to the rear of the helmet rather than upon the crown above the visor. A common reason for reverse positioning of the goggles is to accommodate helmet-attached face shields. In most hazardous chemical exposure situations, it is required to have the worker wear both goggles and a face shield. If the shield is knocked off, the eyes are still protected, preventing the most serious of the two potential injuries from occurring. When clear of the hazard area, the shield is swivelled to a position above the safety helmet and out of the worker's field of vision. In the forwardly mounted position, the goggles would prevent rotation of the shield above the helmet and out of the field of vision. Positioning the goggles to the rear eliminates the blocking problem.

Additionally, although the preferred embodiment illustrates a safety helmet having pockets formed on either side, the strap retainers can be mounted onto the helmet by other convenient means, for example by a screw fastener, or by an adhesive deposit.

Although the invention has been described with reference to a specific embodiment and with reference to a safety helmet, the foregoing description is not intended to be construed in a limiting sense. Various modifications of the disclosed embodiment as well as alternative applications of the invention will be suggested to persons skilled in the art by the foregoing specification and illustrations. For example, the strap retainer arrangement can be used to good advantage in combination with other helmets, for example of the type used by fire-fighting personnel. It is therefore contemplated that the appended claims will cover any such modifications or embodiments that fall within the true scope of the invention.

What is claimed is:

1. A retainer for engaging a goggles strap comprising a body member having first and second end portions, said body member having an open slot for receiving a goggles strap, said slot being formed in said body member intermediate the first and second end portions, thereby defining a hook on one of said end portions fore restraining the goggles strap, and said body member including attachment means projecting from said body member for securing said retainer to a safety helmet engaged by the goggles strap.

2. A retainer as defined in claim 1, said attachment means comprising first and second resilient arms projecting from said body member for insertion into a socket formed on said safety helmet.

3. A retainer as defined in claim 2, each resilient arm having a latching portion for establishing detented engagement with the safety helmet when the arms are fully inserted into said socket.

4. A retainer as defined in claim 2, including a stub projecting from said body member substantially in parallel relation with said first and second arms, said stub being substantially centrally located with respect to said resilient arms, with a clearance space being defined between the stub and each of said arms.

5. An improved safety helmet of the type having a crown and a visor projecting forwardly of said crown, the improvement comprising first and second retainers mounted onto said helmet on opposite sides of said crown, each retainers having a body member including first and second end portions, said body member having an open slot for receiving a flexible strap, said slot being formed in said body member intermediate the first and second end portions thereby defining a hook on one of said end portions for restraining the flexible strap of safety goggles, whereby safety goggles can be retained against the crown of said safety helmet, with the flexible strap of the goggles being inserted into the slot of each retainer and looped around the hook portion of each retainer on opposite sides of said crown.

6. The improved safety helmet as defined in claim 5, said safety helmet comprising a shell with first and second pockets formed in said shell on opposite sides of said crown, and each retainer including attachment means projecting from said body member for insertion into said socket.

7. An improved safety helmet as defined in claim 6, said shell including first and second bracket panels spaced from said shell on opposite sides of said crown, said pockets being formed intermediate said bracket panels and said shell.

* * * * *

UNITED STATES PATENT AND TRADEMARK OFFICE

CERTIFICATE OF CORRECTION

PATENT NO. : 4,764,989

DATED : August 23, 1988

INVENTOR(S) : Roy M. Bourgeois

It is certified that error appears in the above-identified patent and that said Letters Patent is hereby corrected as shown below:

Column 1, line 21, delete "the".

Column 3, line 2, insert "a" before "safety helmet".

Column 3, line 39, delete "the".

Column 3, line 41, "crow" should be -- crown --.

Column 3, line 56, "weaking" should be -- weakening --.

Column 4, line 55, "arm" should be -- arms --.

Column 7, line 9, "fore" should be -- for --.

Column 8, line 5, "retainers" should be -- retainer --.

Signed and Sealed this

Third Day of January, 1989

*Attest:*

DONALD J. QUIGG

*Attesting Officer*

*Commissioner of Patents and Trademarks*